US006120321A

United States Patent [19]

Wu

[11] Patent Number: 6,120,321

[45] Date of Patent: Sep. 19, 2000

[54] ELECTRICAL CONNECTOR ASSEMBLY

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/273,893

[22] Filed: Mar. 22, 1999

[30] Foreign Application Priority Data

Mar. 21, 1998 [TW] Taiwan ..... 87204256

[51] Int. Cl.[7] ..... H01R 13/60

[52] U.S. Cl. ..... 439/541.5

[58] Field of Search ..... 439/541.5, 79, 439/80, 607

[56] References Cited

U.S. PATENT DOCUMENTS

| | | | |
|---|---|---|---|
| 4,756,695 | 7/1988 | Lane et al. | 439/79 |
| 5,281,169 | 1/1994 | Kiat et al. | 439/607 |
| 5,564,949 | 10/1996 | Wellinsky | 439/607 |
| 5,637,015 | 6/1997 | Tan et al. | 439/607 |
| 5,797,770 | 8/1998 | Davis et al. | 439/607 |
| 5,984,726 | 11/1999 | Wu | 439/607 |

*Primary Examiner*—Brian Sircus
*Assistant Examiner*—J. F. Duverne
*Attorney, Agent, or Firm*—Wei Te Chung

[57] ABSTRACT

An electrical connector assembly comprises at least two types of connectors having different transmission rates. The electrical connector assembly mainly comprises a number of contacts each comprising a contacting end and a jointing end, and an integral insulative housing divided into several sections thereby forming at least a first insulative receptacle and a second insulative receptacle each defining engaging slots for receiving a mating connector. Each engaging slot having a mating board extending therethrough for receiving the corresponding contacts. A shielding device comprises a number of shells fixed to the housing thereby providing the electrical connector assembly with excellent shielding capabilities. At least a positioning member is fixed to the electrical connector assembly for positioning the jointing ends of the contacts thereby ensuring proper signal transmission.

18 Claims, 4 Drawing Sheets

ELECTRICAL CONNECTOR ASSEMBLY

BACKGROUND OF THE INVENTION

The present invention relates to an electrical connector assembly, and more particularly to an electrical connector assembly having two stacked connectors for providing robust space on a motherboard and easy assembly.

Limited inner space of a motherboard of a computer and an increase in the number of functions demanded of the computer both contribute to the current miniaturization trend of electrical components mounted on the motherboard of the computer. Furthermore, more space on the motherboard is being utilized for depositing additional electrical components having improved functions.

Conventionally, an electrical connector, which adapts to be mounted to appropriate I/O positions of a motherboard of a computer, is separately assembled to the motherboard and is in alignment with corresponding holes on a computer shell when the motherboard is assembled within the computer shell. However, if a motherboard has high density electrical components mounted thereon and remains a limited free space, such a method of arrangement and assembly is disadvantageous because of decreasing available space. Moreover, the connectors might be latched to the computer shell by screws thereby complicating assembly and hindering mass production.

BRIEF SUMMARY OF THE INVENTION

A main object of the present invention is to provide an electrical connector assembly for facilitating efficient utilization of limited use of a motherboard.

Another object of the present invention is to provide an electrical connector assembly including connectors of different transmitting rates and facilitating attachment to a computer shell with as short distance as possible between the electrical connector assembly and the computer shell.

A further object of the present invention is to provide an electrical connector assembly combining at least two types of integrally stacked electrical connectors according to functional requirements of factual designations for facilitating mass manufacture.

In accordance with one aspect of the present invention, an electrical connector assembly comprises at least two types of electrical connectors having different transmission rates. The connector assembly comprises an integral insulative housing including individual insulative housings of corresponding constituent connectors, a plurality of contacts and a shielding device for shielding the contacts. The shielding device comprises several shells. The integral housing is divided into several sections defining corresponding mating chambers for receiving corresponding mating connectors. An engaging board is integrally formed in each mating chamber for receiving the corresponding contacts. At least a positioning device comprising at least a positioning member is attached between the shells and jointing ends of the contacts. Each positioning member defines a plurality of slots for positioning corresponding jointing ends of the contacts received in the engaging board thereby facilitating attachment of the connector assembly to a motherboard.

Other objects, advantages and novel features of the invention will become more apparent from the following detailed description when taken in conjunction with the accompanying drawings.

DETAILED DESCRIPTION OF THE INVENTION

Figure 1:
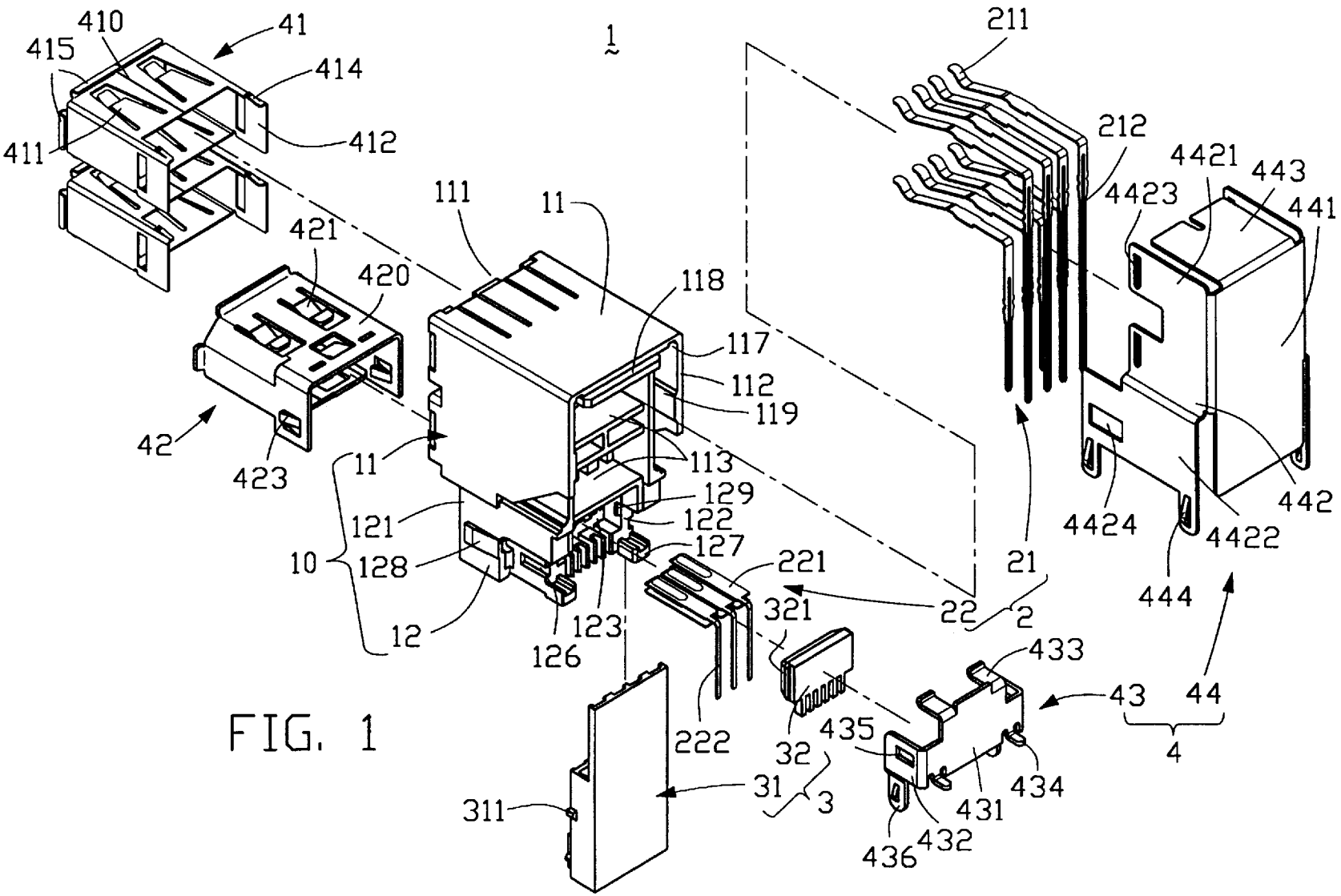
FIG. 1 is an exploded perspective view of an electrical connector assembly in accordance with the present invention.
Figure 3:
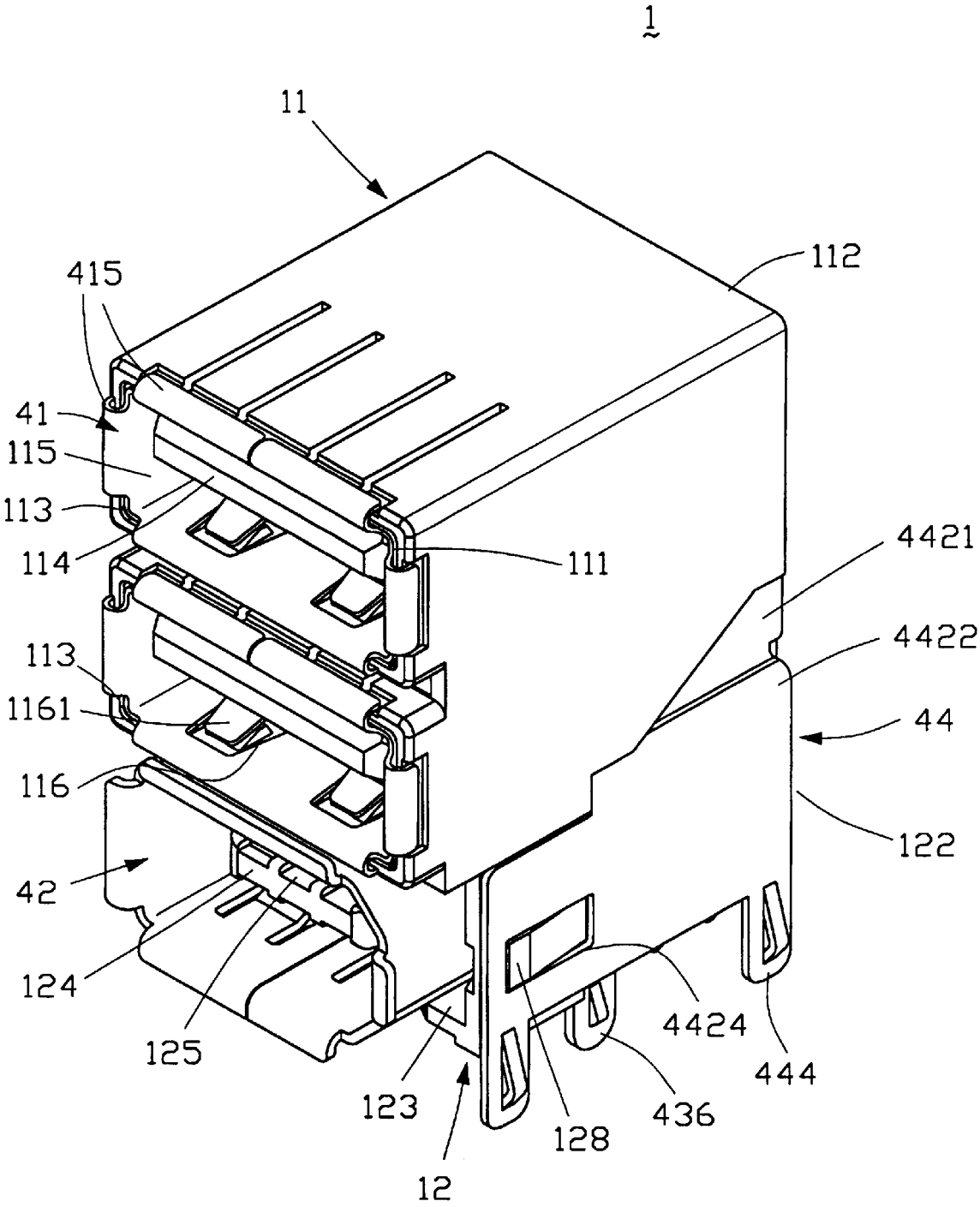
FIG. 3 is an assembled view of FIG. 1.

Referring to FIGS. 1 and 3, an electrical connector 1 in accordance with the present invention comprises an integral insulative housing 10, a positioning device 3 attached to relative lower portions of the housing 10 and a shielding device 4 enclosing and received in appropriate positions of the housing 10. The housing 10 is divided into several sections for receiving two or more corresponding insulative receptacles therein. In the preferred embodiment, the sections defined in an upper portion of the integral housing 10 form a first insulative receptacle 11, while the sections defined in a lower portion of the housing 10 forms a second insulative receptacle 12.

The first insulative receptacle 11 has a first mating surface 111, a first jointing surface 112 opposite the first mating surface 111 and a pair of first engaging slots 113. The first engaging slots are defined between the first mating surface 111 and the first jointing surface 112 for receiving a first mating connector (not shown). A first mating board 114 integrally extends an appropriate length from the jointing surface 112 to the mating surface 111 in each first engaging slot 113. Thus, the first mating board 114 defines a chamber 115 between the first mating board 114 and a top inner wall of the corresponding first engaging slot 113 for further securing the first mating connector (not shown) thereof.

The second insulative receptacle 12 has a second mating surface 121 and a second jointing surface 122 opposite the second mating surface 121. A second engaging slot 123 is defined between the second mating surface 121 and the second jointing surface 122. A second mating board 124 extends from the second jointing surface 122 to the second mating surface 121 for engaging with a second mating connector. A plurality of channels 125 are defined in opposite surfaces of the second mating board 124. As is known, the first mating boards 114 of the first receptacle 11 forms a plurality of channels (not shown) the same as the channels 125 therein.

Contacts 2 comprise first contacts 21 for being received in the first insulative receptacle 11 and second contacts 22 for being received in the second insulative receptacle 12. Each first contact 21 has a contacting end 211 for being received in the corresponding channels of the first mating board 114 and a jointing end 212 bent an appropriate angle relative to the contacting end 211 and downwardly extending along the first jointing surface 112 toward a bottom side of the housing 10 for electrically connecting to a mating circuit board (not shown). Each second contact 22 has a U-shaped contacting end 221 for being received in the apertures 125 of the second mating board 124 and a jointing end 222 bent an appropriate angle relative to the contacting end 221 and downwardly extending along the second jointing surface 122 toward the bottom side of the housing 10 for electrically connecting to the mating circuit board.

Figure 2:
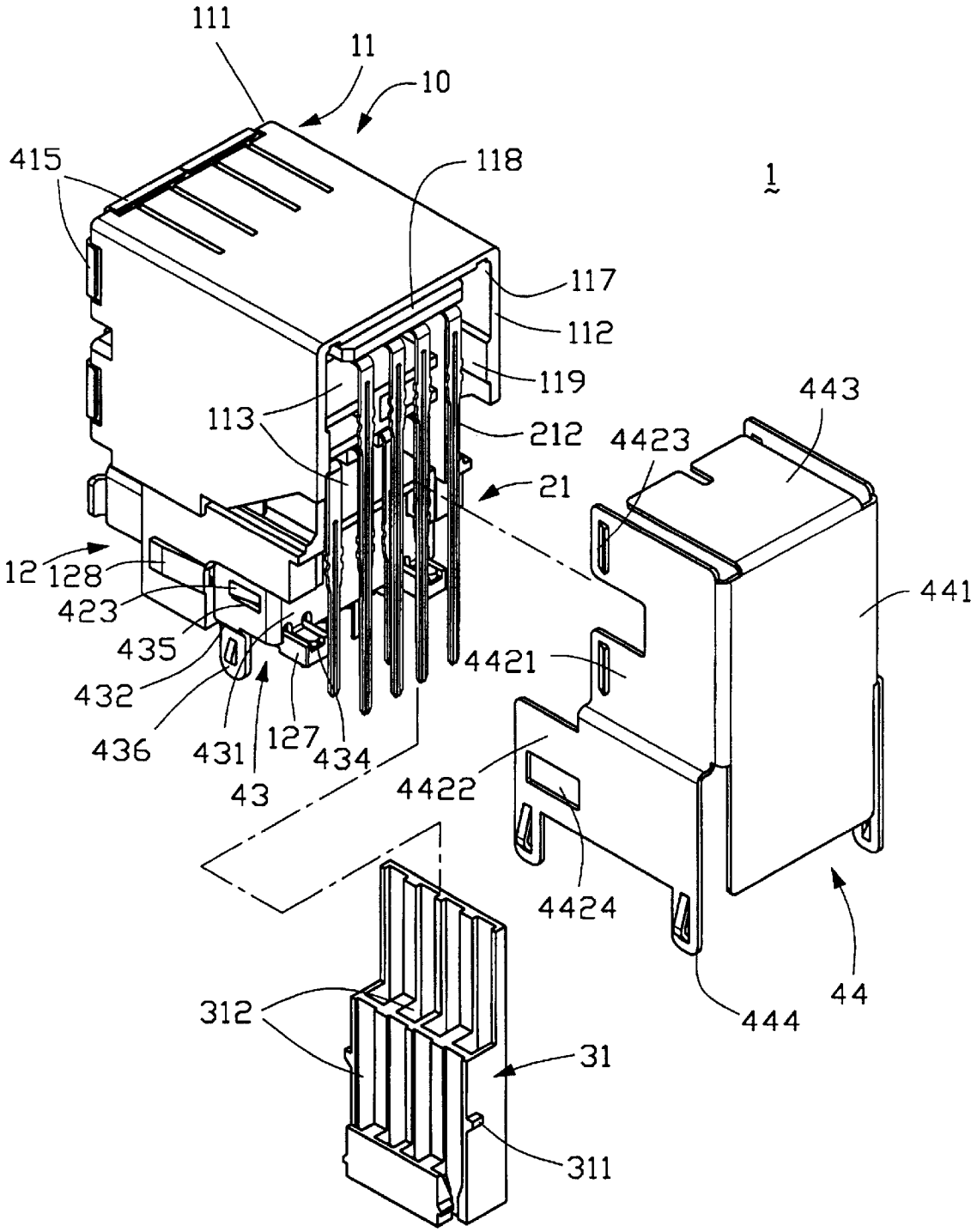
FIG. 2 is a partially assembled view of FIG. 1.

Also referring to FIG. 2, the shielding device 4 comprises two first shells 41, a second shell 42, an inner shell 43 and an outer shell 44. The first shells 41 are received in the corresponding first engaging slot 113 of the first insulative receptacle 11. Each first shell 41 includes a first frame 410 to be received in the corresponding first engaging slot 113 and a plurality of resilient clips 411 integrally stamped from top and bottom surfaces of the first frame 410. Each resilient chip 411 forms several folds thereby providing proper contact sections for contacting an outer shell of a mating connector. A plurality of sliding slots 116 having projecting blocks 1161 therein are formed in a top inner surface and a bottom inner surface of each first engaging slot 113 for properly guiding the first shell 41 into the first engaging slot 113 via cooperation between the sliding slots 116 and the corresponding first resilient clips 411 thereby engaging the projecting blocks 1161 with the first resilient clips 411 of the corresponding first frame 410. A pair of side projections 412 rearwardly extends from opposite sides of each first shell 41. Each side projections 412 forms an inwardly bent top flange 414 on a top edge thereof for engaging with a corresponding groove 117 defined in the first insulative receptacle 11. Several barb-like flanges 415 outwardly extend from a first periphery of each first shell 41 for latching with a periphery of the mating surface 111 of the first insulative receptacle 11 and providing guiding and partial securing effects when the first shells 41 are inserted into the corresponding first engaging slots 113 of the first insulative receptacle 11.

The second shell 42 comprises a second frame 420 for being received in the second engaging slot 123 of the second insulative receptacle 12 and a plurality of second resilient clips 421 stamped from top and bottom surfaces of the second frame 420. A plurality of sliding slots (not shown) forming projecting blocks (not shown) therein are defined in top and bottom inner surfaces of the second engaging slot 123 for properly guiding the second shell 41 into the second engaging slot 123 via cooperation between the sliding slots and the corresponding second resilient clips 421 thereby engaging the projecting blocks with the corresponding second resilient clips 421 of the second frame 420. A pair of latching tabs 423 outwardly extend from opposite side walls of the second frame 420 for engaging with corresponding latching apertures 126 defined in outer surfaces of opposite side walls of the second insulative receptacle 12 when the second shell 42 is inserted into the second engaging slot 123 thereby preventing the second shell 42 from disengaging from the second insulative receptacle 12 during assembly.

The inner shell 43 encloses the jointing surface 122 of the second insulative receptacle 12. The inner shell 43 mainly comprises a first rear wall 431 parallel to the jointing surface 122 and a pair of first side walls 432 extending perpendicularly from the first rear wall 431. Two latching bars 433 perpendicularly extend from a top edge of the rear wall 431 for engaging with latching recesses (not shown) defined in corresponding inner side walls of the second engaging slot 123 of the second insulative receptacle 12. Two bent legs 434 extend perpendicularly rearward from a bottom edge of the first rear wall 431 for engaging with blocks 127 rearwardly extending from a bottom of the jointing surface 122 of the second insulative receptacle 12 thereby properly positioning the inner shell 43 on the second insulative receptacle 12. A rectangular aperture 435 is defined in each first side wall 432 corresponding to the latching apertures 126 of the second insulative receptacle 12 for enabling the latching tabs 423 of the second shell 42 to simultaneously engage with the corresponding latching apertures 126 and rectangular apertures 435 thereby fixing the second shell 42 and the inner shell 43 to the second insulative receptacle 12. A pair of jointing legs 436 downwardly extend from the first side walls 432 and form barbs thereon for securing to the mating circuit board.

The outer shell 44 includes a second rear wall 441 enclosing the first and second jointing surfaces 113 and 122 of the first and the second insulative receptacles 11, 12, a pair of second side walls 442 and a top wall 443 extending from the second rear wall 441 for integrally engaging with a top receiving groove 118 formed in a top inner side wall of the first engaging slot 113. Each side wall 442 comprises an upper section 4421 extending from the second rear wall 441 and a lower section 4422 downwardly extending from and bent slightly outward relative to the upper section 4421. The upper section 4421 is interferentially engage with a middle receiving grooves 119 defined in the inner side walls of the first engaging slot 113. A first latching barb 4423 projects from each second side wall 442 for abutting against the inner side walls of the first engaging slot 113. The lower sections 4422 abut against outer surfaces of the corresponding second side walls 442 of the second insulative receptacle 12 via perforations 4424 defined therein engaging with corresponding projecting blocks 128 formed on the outer surfaces of the second side walls 442 of the second insulative receptacle 12 thereby integrally securing the outer shell 44 to the second insulative receptacle 12. Several latching barbs 444 outwardly extend from a bottom edge of the second side walls 442 for securing to the mating circuit board.

Figure 4:
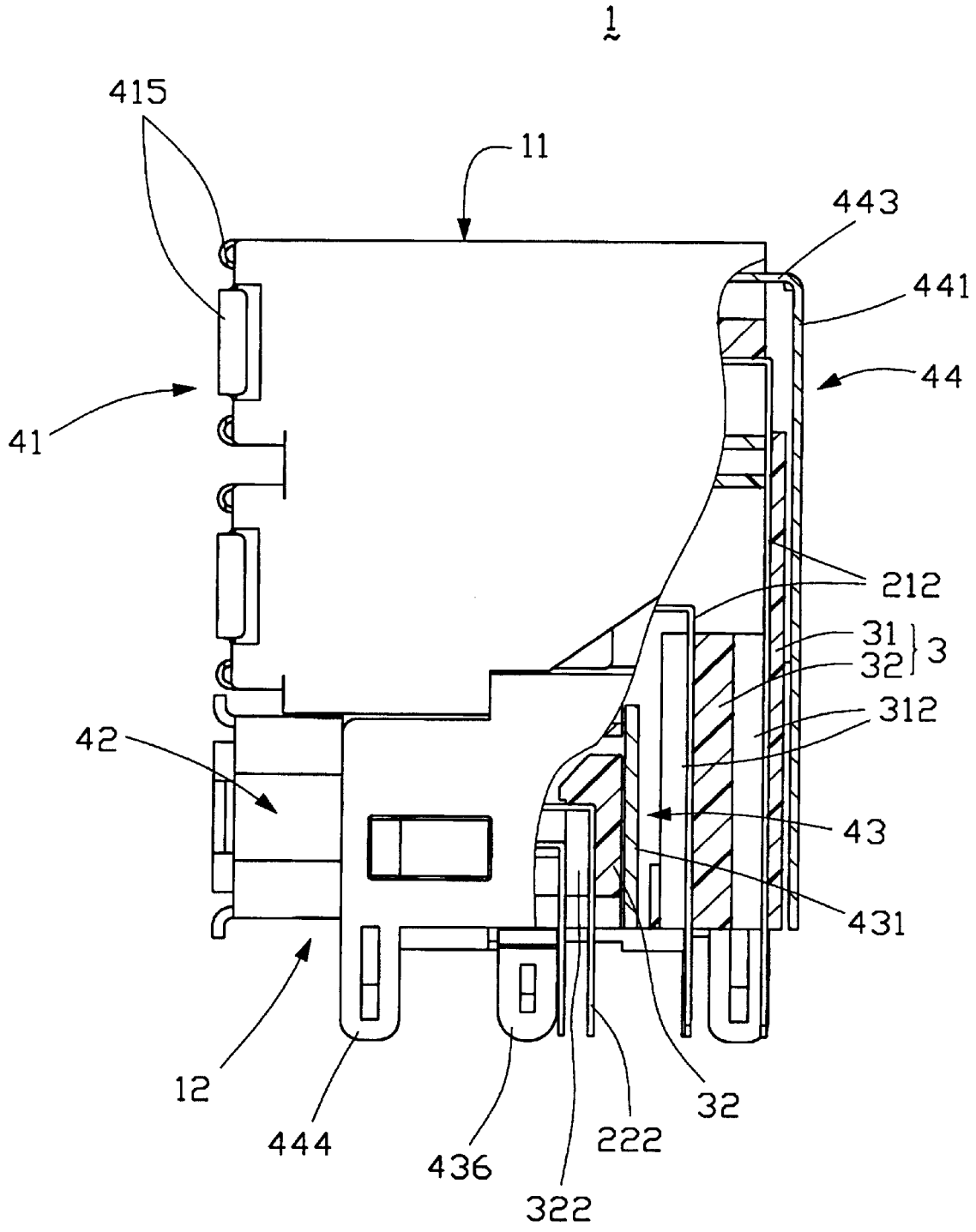
FIG. 4 is a partial sectional view of the connector assembly.

Also referring to FIG. 4, the positioning member 3 comprises a first positioning member 31 and a second positioning member 32. The second positioning member 32 received between the second insulative receptacle 12 and the inner shell 43 forms a pair of lateral flanges 321 on opposite side walls thereof for engaging corresponding projecting blocks 129 formed on inner side walls of the second insulative receptacle 12. A plurality of second grooves 322 are defined in a front surface of the second positioning member 32 for securely receiving the jointing ends 222 of corresponding second contacts 22. The first positioning member 31 is disposed between the inner and outer shells 43, 44 and abuts against the inner side walls of the first engaging slot 113 via a pair of ears 311 protruding from opposite side walls thereof. A plurality of first grooves 312 are defined in a front surface of the first positioning member 31 for securely receiving the jointing ends 222 of corresponding first contacts 21 thereof.

After integrally assembling all of the components of the connector assembly 1, the first and the second insulative receptacle 11, 12 come into effects and are vertically stacked on each other. Thus, not only is the space on the mating circuit board occupied by the first and second insulative receptacles 11, 12 conserved, but a dense arrangement of additional electrical elements on the mating circuit board is also facilitated. Moreover, the first insulative receptacle 11 and the second insulative receptacle 12 can be simultaneously positioned on the mating circuit board as a unit and the contacts 2 can be electrically connected to the mating circuit board synchronously thereby simplifying manufacturing procedures and facilitating mass production.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly integrally combining at least two types of electrical connectors having different transmission rates, comprising:

an integral insulative housing divided into a plurality of sections forming at least a first insulative receptacle and a second insulative receptacle, each insulative receptacle having a mating surface, a jointing surface opposite the mating surface, and an engaging slot defined between the mating surface and the jointing surface, a plurality of channels being formed in each engaging slot;

a plurality of contacts received in corresponding apertures of the integral insulative housing, each contact comprising a contacting end outwardly extending from the corresponding aperture for electrically contacting a mating connector and a jointing end downwardly extending along the jointing surface of a corresponding insulative receptacle for electrically connecting with a mating circuit board; and a shielding device comprising at least a first shell received in the first engaging slot of the first insulative receptacle and a second shell received in the second engaging slot of the second insulative receptacle for shielding the contacts.

2. The electrical connector assembly as claimed in claim 1, wherein a mating board is formed in the engaging slot of each insulative receptacle, each mating board extending a predetermined length from the jointing surface toward the mating surface for engaging with a mating connector received in the engaging slot, the apertures being defined in opposite surfaces of each mating board.

3. The electrical connector assembly as claimed in claim 2, wherein the first shell includes at least a first frame engaging with the first engaging slot and a plurality of resilient clips integrally stamped from top and bottom surfaces thereof, the resilient clips forming several folds.

4. The electrical connector assembly as claimed in claim 3, wherein a plurality of sliding slots with projecting blocks formed therein are defined in top inner and bottom inner surfaces of the first engaging slot of the first insulative receptacle for guiding the first shell into the first engaging slot via cooperation between the sliding slots and the corresponding first resilient clips, thereby engaging the projecting blocks with the corresponding first resilient clips of each first frame.

5. The electrical connector assembly as claimed in claim 4, wherein a pair of side projections extend from opposite sides of each first shell, each side projection forming an inwardly bent top flange on a top edge thereof for engaging with a corresponding groove defined in the first insulative receptacle, and several barb-like flanges outwardly extending from a front periphery of each first shell for latching with a periphery of the mating surface of the first insulative receptacle and for guiding and securing the first shells in the corresponding first engaging slots of the first insulative receptacle.

6. The electrical connector assembly as claimed in claim 5, wherein the second shell comprises a second frame received in the second engaging slot of the second insulative receptacle and a plurality of second resilient clips stamped from top and bottom surfaces of the second frame.

7. The electrical connector assembly as claimed in claim 6, wherein a plurality of sliding slots forming projecting blocks therein are formed on top and bottom inner surfaces of the second engaging slot for properly guiding the second shell into the second engaging slot via cooperation between the sliding slots and the corresponding second resilient clips, the projecting blocks engaging with the corresponding first resilient clips of the second frame.

8. The electrical connector assembly as claimed in claim 7, wherein a pair of latching tabs outwardly extend from opposite side walls of the second frame for engaging with corresponding latching apertures defined in outer surfaces of opposite side walls of the second insulative receptacle, thereby preventing the second shell from disengaging from the second insulative receptacle during assembly.

9. The electrical connector assembly as claimed in claim 1, wherein the shielding device comprises an inner shell enclosing the jointing surface of the second insulative receptacle, the inner shell comprising a first rear wall parallel to the jointing surface and a pair of first side walls extending perpendicularly from the first rear wall.

10. The electrical connector assembly as claimed in claim 9, wherein two latching bars perpendicularly extend from a top edge of the rear wall for engaging with latching recesses defined in corresponding inner side walls of the second engaging slot of the second insulative receptacle, and two bent legs extending perpendicularly rearward from a bottom edge of the first rear wall for engaging with blocks rearwardly extending from a bottom of the jointing surface of the second insulative receptacle thereby properly positioning the inner shell on the second insulative receptacle.

11. The electrical connector assembly as claimed in claim 10, wherein a rectangular aperture is defined in each first side wall corresponding to the latching apertures of the second insulative receptacle for enabling the latching tabs of the second shell to simultaneously engaging with the corresponding latching apertures and rectangular apertures thereby fixing the second shell and the inner shell to the second insulative receptacle, and a pair of jointing legs downwardly extending from the first side walls and form barbs thereon for securing to the mating circuit board.

12. The electrical connector assembly as claimed in claim 11, wherein the shielding device comprises an outer shell, including a second rear wall enclosing the first and second jointing surfaces of the first and the second insulative receptacles, a pair of second side walls and a top wall extending from the second rear wall for interferentially engaging with a top receiving groove formed in a top inner side wall of the first engaging slot.

13. The electrical connector assembly as claimed in claim 12, wherein each side wall comprises an upper section extending from the second rear wall and a lower section downwardly extending from and bent slightly outward relative to the upper section.

14. The electrical connector assembly as claimed in claim 13, wherein the upper section interferentially engage with middle receiving grooves defined in the inner side walls of the first engaging slot, a first latching barb projecting from each second side wall for abutting against the inner side walls of the first engaging slot.

15. The electrical connector assembly as claimed in claim 14, wherein the pair of lower sections abut against outer surfaces of the corresponding second side walls of the second insulative receptacle by engaging perforations defined therein with corresponding projecting blocks formed on the outer surfaces of the second side walls of the second insulative receptacle, thereby securing the outer shell to the second insulative receptacle.

16. The electrical connector assembly as claimed in claim 1 further comprising a positioning device comprising at least a first positioning member defining a plurality of first grooves in a front surface thereof for securely receiving the corresponding jointing ends of corresponding contacts.

17. The electrical connector assembly as claimed in claim 16, wherein the first positioning member extends in a direction along the jointing surface of the first insulative receptacle and engages with the first insulative receptacle via a pair of ears formed on opposite outer side walls thereof abutting against corresponding inner side walls of the engaging slot of the first insulative receptacle.

18. The electrical connector assembly as claimed in claim 17, wherein the positioning device further comprises a second positioning member defining a plurality of second grooves in a front surface thereof for securely receiving the jointing ends of the corresponding contacts and a pair of lateral flanges formed on opposite outer side walls of the second positioning member for engaging a pair of projecting blocks formed on inner side walls of the second insulative receptacle.

* * * * *